United States Patent [19]

Fleischmann

[11] Patent Number: 4,826,465

[45] Date of Patent: May 2, 1989

[54] MODEL SUBMARINE

[75] Inventor: Lewis W. Fleischmann, Randallstown, Md.

[73] Assignee: Leonard Bloom, Towson, Md. ; a part interest

[21] Appl. No.: 865,790

[22] Filed: May 22, 1986

[51] Int. Cl.[4] ..... A63H 23/02; A63H 23/04; A63H 27/06

[52] U.S. Cl. ..... 446/162; 446/155; 446/211; 114/333; 114/150

[58] Field of Search ..... 446/161, 162, 163, 164, 446/154, 155, 211; 114/357, 333, 150; 440/38, 39

[56] References Cited

U.S. PATENT DOCUMENTS

| | | | |
|---|---|---|---|
| 1,294,922 | 2/1919 | Logusz | 114/333 |
| 2,022,642 | 11/1935 | Hueber et al. | 417/151 X |
| 2,044,088 | 6/1936 | Lord | 417/151 |
| 2,903,822 | 9/1959 | Reid | 446/155 |
| 2,914,887 | 12/1959 | Fleischmann | 446/162 |
| 3,010,255 | 11/1961 | Gordon | 446/162 X |
| 3,036,403 | 5/1962 | Presnell | 446/162 X |
| 3,046,697 | 7/1962 | Pullen | 446/164 |
| 3,078,617 | 2/1963 | Dempsey | 446/154 |
| 3,165,390 | 1/1965 | Parken et al. | 417/151 X |
| 3,181,272 | 5/1965 | Gibson | 446/154 |
| 3,229,420 | 1/1966 | Dias | 446/154 |
| 3,342,032 | 9/1967 | Cox et al. | 440/38 X |
| 3,419,997 | 1/1969 | Owbridge | 446/162 |
| 3,447,552 | 6/1969 | Grosson | 114/337 X |
| 3,545,886 | 12/1970 | Chalom | 417/151 X |

FOREIGN PATENT DOCUMENTS

| | | | |
|---|---|---|---|
| 1298014 | 6/1969 | Fed. Rep. of Germany | 440/38 |
| 2525253 | 12/1976 | Fed. Rep. of Germany | 446/163 |
| 2901442 | 7/1980 | Fed. Rep. of Germany | 446/162 |
| 3244565 | 6/1984 | Fed. Rep. of Germany | 446/162 |
| 830268 | 7/1938 | France | 446/162 |

*Primary Examiner*—Robert A. Hafer
*Assistant Examiner*—D. Neal Muir
*Attorney, Agent, or Firm*—Leonard Bloom

[57] ABSTRACT

A diving model submarine utilizes an automatic depth level control mechanism, water jet propulsion, a water powered aspirator for ballast tank evacuation, hydraulic control of steering, diving plane attitude, and ballast tank valve action. The model diving submarine is controlled by radio signals and fires torpedos.

6 Claims, 10 Drawing Sheets

MODEL SUBMARINE

FIELD OF INVENTION

This invention relates to a diving model submarine which will simulate the maneuvering capabilities of its full size counterpart, running at full surface, periscope depth, and totally submerged.

BACKGROUND OF THE INVENTION

Model submarine enthusiasts have long sought a model submarine which can accurately simulate the maneuverability and characteristics of their real life counterparts. Perhaps the most difficult characteristics to simulate are those involving diving and maintaining a level run at a given depth. In order to achieve these characteristics, two design philosophies have been utilized in model submarine technology. These philosophies are known as the positive buoyancy system (or PBS) and the negative buoyancy system (or NBS). Unfortunately, there are serious disadvantages inherent to both philosophies.

In the PBS system, the model submarine is "trimmed" to be slightly positively buoyant when the ballast tank(s) is/are fully flooded. In this respect, the model submarine employing a positive buoyancy system is failsafe inasmuch as the boat cannot sink to the bottom in the event of a power failure. However, when submerged, model submarines employing PBS have great difficulty with simulating the maneuverability of its full size counterpart. This is due, at least in part, the the dynamic forces acting on the diving planes which are used to force the boat under the surface of the water. These forces make control of the angle of attack of these planes (which also maintains a level run at a given depth) most difficult to achieve, especially since the boat cannot be seen by the operator.

In the NBS system, the model submarine is "trimmed" to be slightly negatively buoyant when the ballast tank(s) is/are fully flooded. While enabling the model submarine to more closely maneuver like its full size counterpart (especially at periscope depth level), these systems are extremely disadvantageous in that should the model submarine's propulsion system fail, the boat will sink necessitating its manual retrieval.

In model submarines of all types, various complicated techniques have been employed to satisfactorily attempt to fill and purge the ballast during diving operations. Many models employ a reversible pump which will pump water into or out of one or more ballast tanks. Other models use free flooding of the tank(s), by opening a vent valve which communicates with the top of the tank, in order to take on a sufficient quantity of water to submerge. In order to surface, these models close the vent valve and then purge the water out of the bottom of the tank using compressed air, freon, or the like. To aid in "trimming", these models are more often than not provided with at least two ballast tanks, one fore and one aft, each ballast tank being provided with its own, separate, flooding and purging means. Alternatively, to aid in "trimming" some models utilize a weight carried by a servo-controlled travelling lead screw which shifts, thereby altering the model's center of gravity. In such methods, the weight is usually positioned in a ballast tank.

Most of the submarine kits presently on the market also require for each model to have various separate watertight compartments in order to house electric motors and electronics, servo-motors, and often the batteries. Watertight shaft seals are therefore required as bulkhead penetrations for propeller shafts, servo-actuator linkages and controls, wire penetrators and the like. These penetrations are all potential leakage sites which could lead to short circuiting, flooding, and power loss resulting in the loss of a submarine. As such, these seals and penetrations require precise and often costly sealing means to effect leak-tight integrity.

Thus, it can be seen that there remains a need to provide a model submarine having an improved design wherein it can maneuver more closely to its full size counterpart and still employ a positive buoyancy system for failsafe operation.

SUMMARY OF THE INVENTION

Accordingly, it is an object of the present invention to provide a model submarine having a single motor-pump unit for propulsion, hydraulic power for maneuvering, and ballast tank purging.

It is a further object of the present invention to provide a model submarine having a single ballast tank evacuated by an aspirator (ejector pump).

It is yet a further object of the present invention to provide a model submarine having self regulating depth control.

It is still further object of the present invention to provide a model submarine having a freely flooding hull and which can therefore have any external shape.

It is another object of the present invention to provide a model submarine having a single articulatable rudder, a single ballast tank and a single articulatable diving plane.

It is yet another object of the present invention to provide a model submarine having an adjustable depth limiting mechanism.

Accordingly, a positively buoyant model submarine is provided, this model comprising a free-flooding hull having at least one water inlet vent hole formed therein. The hull includes a fore, an aft and a mid-section, respectively. A ballast tank is positioned at the center of buoyancy (which, in the embodiment described herein), is the mid-section, of the hull. The ballast tank has an inlet valve and further has a drain port. A single motor-pump unit is located in the aft section of the hull. The motor-pump unit includes a motor and a pump. The pump has an inlet port and further has a main discharge port and a subsidiary discharge port. A battery is confined within the bounds of the ballast tank and coincident with its center of buoyancy for energizing the motor. A discharge pipe is mounted on the aft section of the hull, extending therethrough. Means is provided in the form of an ejector pump (aspirator) connecting the discharge nozzle to the main discharge of the pump, thereby drawing water out of the drain port of the ballast tank via the ejector pump. An articulatable rudder is positioned on the aft section of the hull. An electrically-responsive first hydraulic valve means is positioned in the aft section of the hull. This valve means is connected to the subsidiary discharge of the pump. A first hydraulically-responsive means is connected to the first hydraulic valve means to the rudder, thereby providing for steering control. A second hydraulic valve means is provided in the fore section of the hull being connected to the subsidiary discharge of the pump. A second hydraulically-responsive means connects the second hydraulic valve means to the inlet valve in the ballast tank, thereby controlling the flooding of the ballast tank. An articulatable diving plane is mounted on the fore section of the hull. A third hydraulic valve means is positioned in the fore section of the hull an is connected to the subsidiary discharge of the pump. A third hydraulically-responsive means connects the third hydraulic valve means to the articulatable diving plane, thereby controlling the attitude of the submarine in the water. Each of the first, second and third hydraulic valve means use ambient water for this actuation, and are responsive to electrical signals, respectively, and a receiver in the hull for accepting command signals from a remote source and generating the respective electrical signals for controlling the submarine through the first, second and third hydraulic valve means, respectively.

Accordingly, a positively buoyant model submarine is provided. This model has, in combination, a free flooding hull, a hydraulic propulsion means, and a single ballast tank being continually purged by the propulsion means. Also provided is a ballast tank flooding means, wherein by alternative flooding and purging of the ballast tank, diving and underwater operation of the model is enhanced. Finally, an open circuit hydraulic control system means, positioned within the free flooding hull is provided for controlling flooding of the ballast tank, movement of the forward planes and movement of the rudders.

These and other objects of the present invention will become apparent from a reading of the following specification taken in conjunction with the enclosed drawings.

DESCRIPTION OF THE PREFERRED EMBODIMENT

Figure 1:
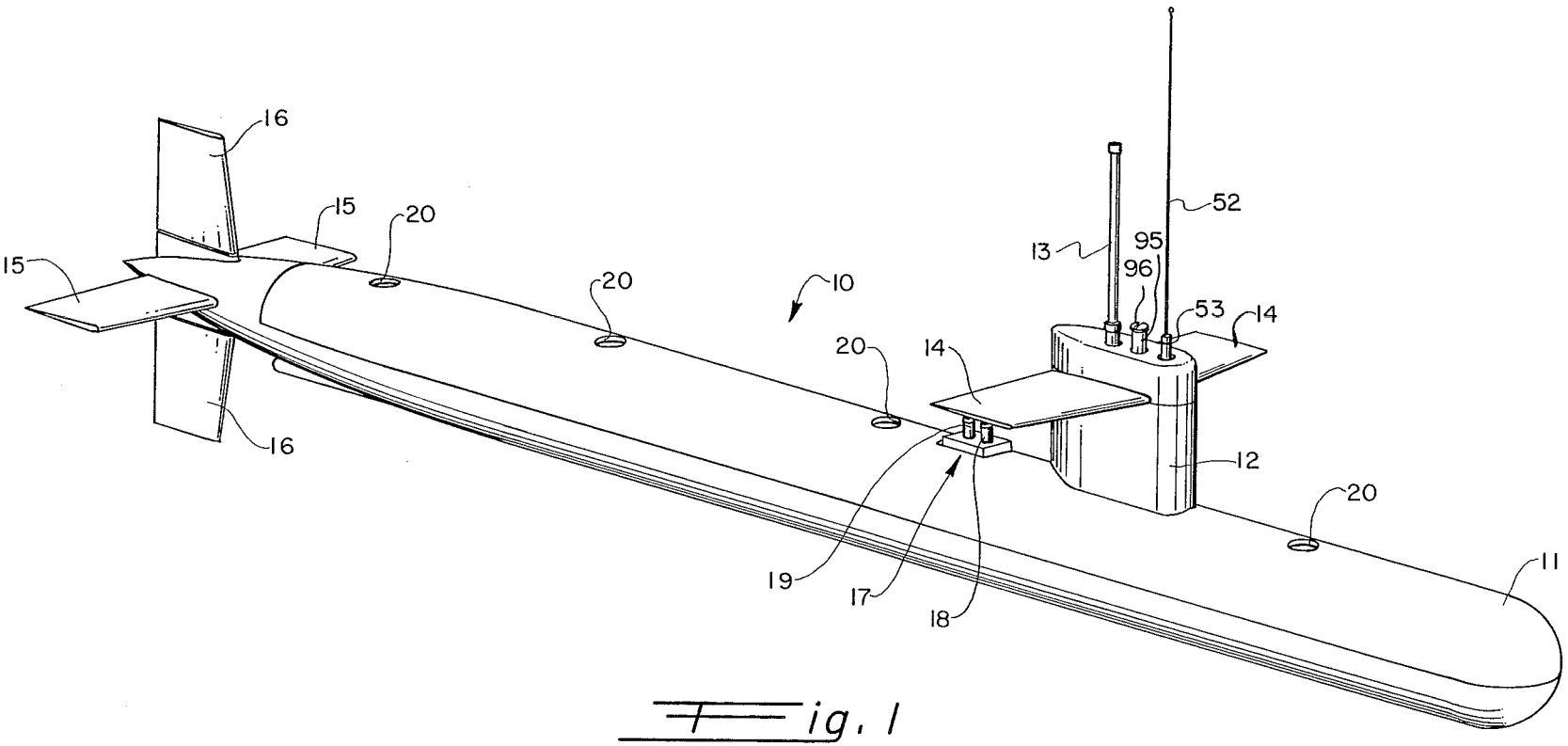
FIG. 1 is a perspective view of the model submarine of the present invention.

With reference now to the drawings, and in particular to FIG. 1, the positively buoyant model submarine 10 of the present invention is provided with a two piece hollow hull 11 constructed of suitable material. This model is shaped to simulate the physical appearance of its lifesize counterpart and includes a conning tower 12, a periscope 13, forward planes 14, stern planes 15 and rudders 16. The model 10 is also provided with an on/-off switch housing 17 having a motor pump switch 18 and an electronics switch 19. The model 10 is further provided with a plurality of apertures 20 formed in the upper and lower portions of the hull 11.

Figure 2A:
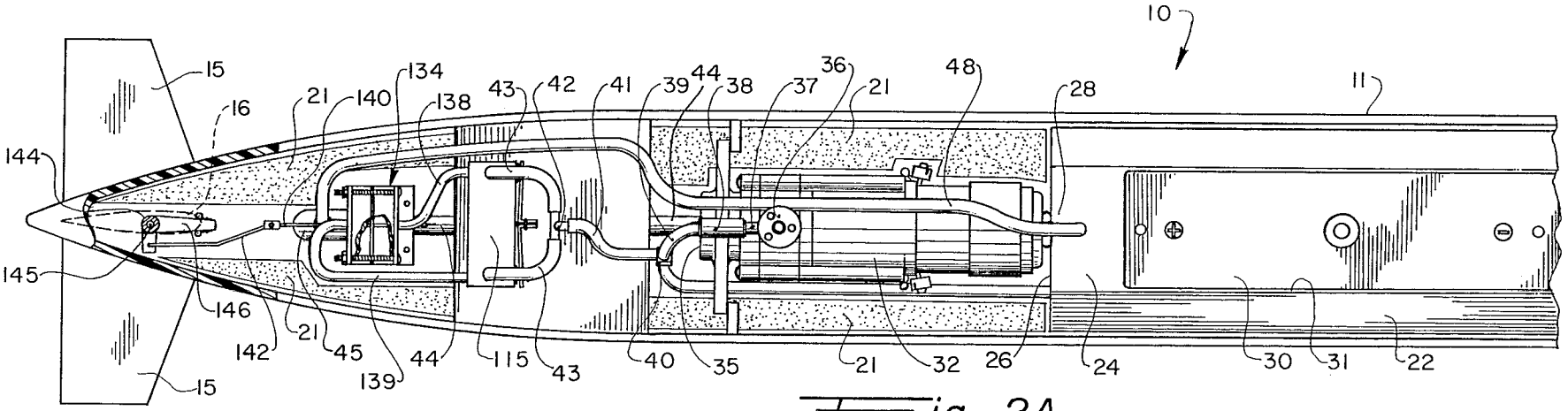
FIG. 2A and 2B are, an overhead view of respectively the aft section and the fore section of the model submarine with the upper plate of the hull removed and part of the aft hull removed to reveal the inner workings thereof.
Figure 2B:
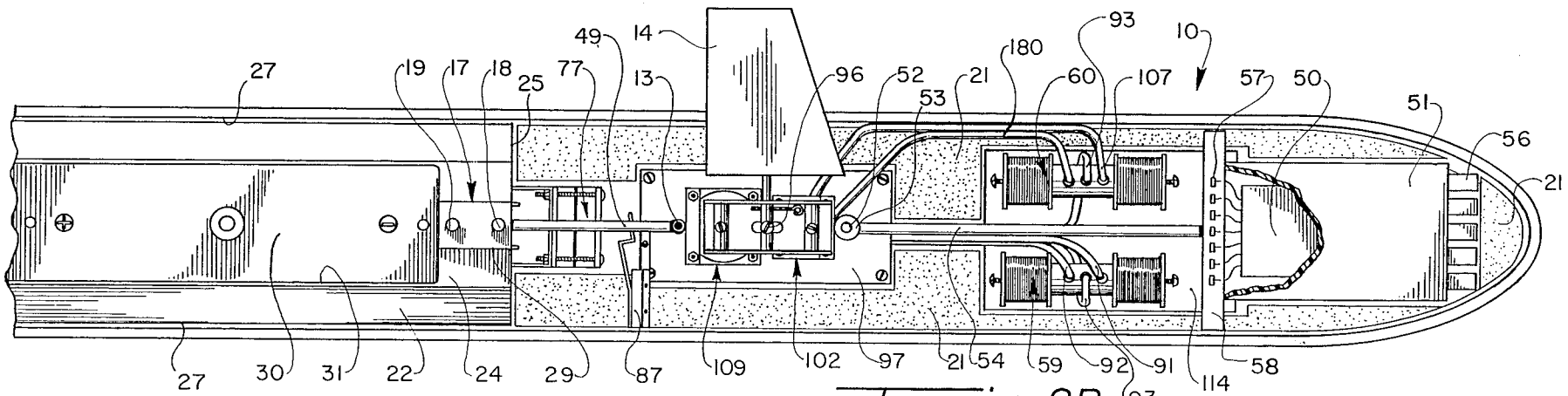
Figures 3A, 3B, 4:
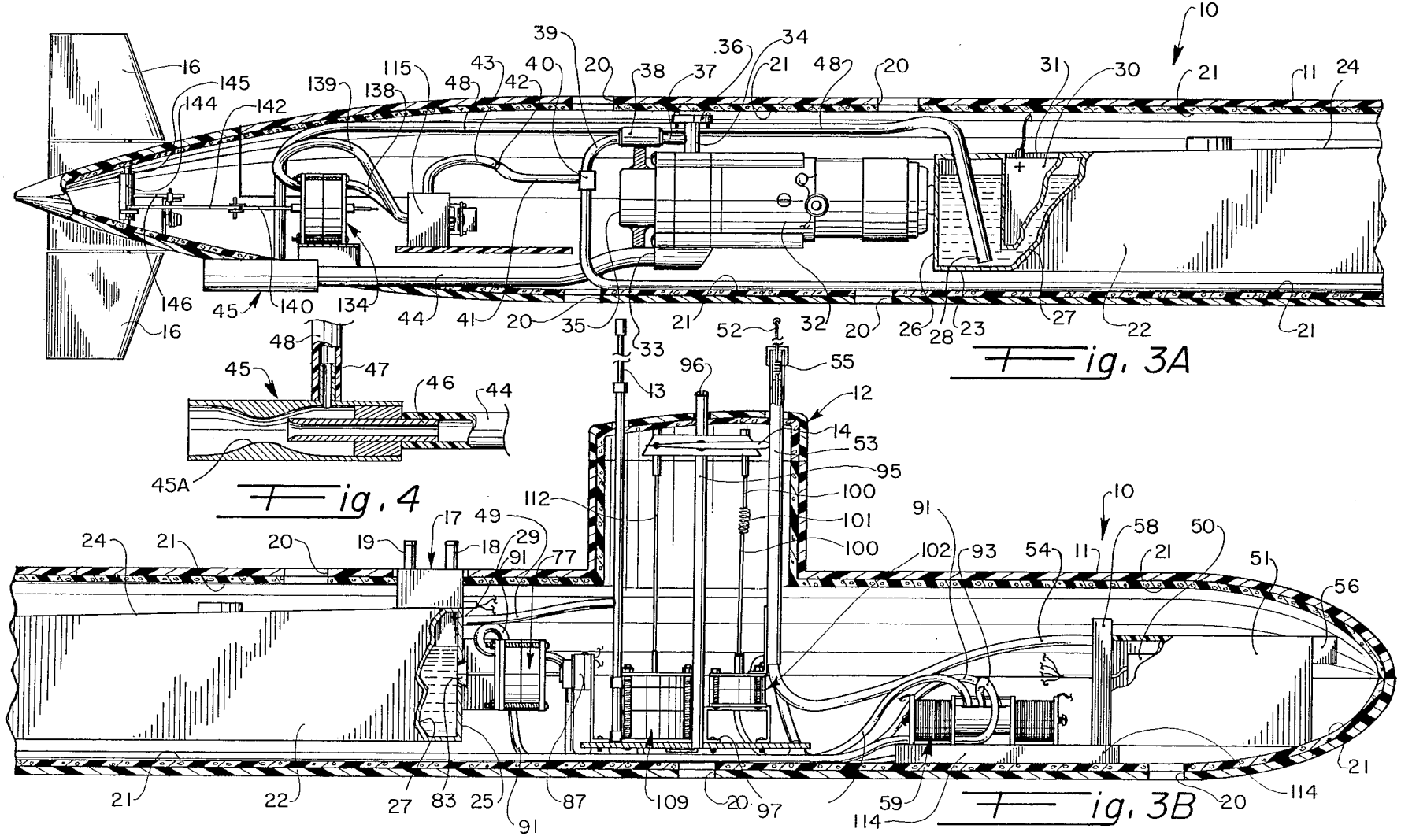
FIGS. 3A and 3B are a side view, in cross-section, of, respectively, the aft and fore sections of the model submarine.
FIG. 4 is a cross-section view of the ejector pump of the model submarine.

Referring now to FIG. 2A and 2B and with additional reference to FIGS. 3A and 3B, the single chamber, free-flooding hull 11 of the model submarine 10 is presented. Hull 11 is fitted with a layer of styrofoam 21 which aids in providing the model with an overall positive buoyancy. Hull 11 is also formed with a plurality of Hull flooding apertures 20, positioned in a spaced relationship along the top and the bottom thereof. When the model 10 is placed in the water, these apertures 20 permit water from the surrounding environment to freely fill the hull 11 and permits air within the hull to vent out through the apertures formed along the top of the hull 11. Conversely, apertures 20 also permit water within the hull to drain therefrom when the model 10 is removed from the water.

Centrally positioned within the hull is a ballast tank 22. This tank 22 is formed with a base 23, a sloped to wall 24, a forward wall 25, a rear wall 26 and side walls 27. Tank 22 is positioned so that it is provided with a lowestmost point 28 (see FIG. 3A) located in the bottom of the rearward end of the ballast tank 22 and a highest most point 29 (see FIG. 3B) located at the top of the forward end of the ballast tank 22. In all cases, the ballast tank 22 is sealed, whereby the flow of water to and from said ballast tank 22 is controlled in a manner and for purposes which shall be discussed later.

Positioned coincident with the center of buoyancy (gravity) of the ballast tank 22 are batteries 30 which are either sealed in a watertight battery housing 31 or are themselves sealed. Energy from these batteries 30 provides the model 10 with the electrical power needed for its operation. The batteries 30 power, among other things a conventional motor-pump unit that is preferably positioned in a watertight motor/pump housing 32. As will be understood by those skilled in the art, said motor/pump unit can, alternatively, itself be formed so as to be submersible. This conventional motor/pump unit is comprised of a motor that drives a magnetic coupling which, in turn, drives a centrifugal impeller pump by magnetic coupling.

Figure 12:
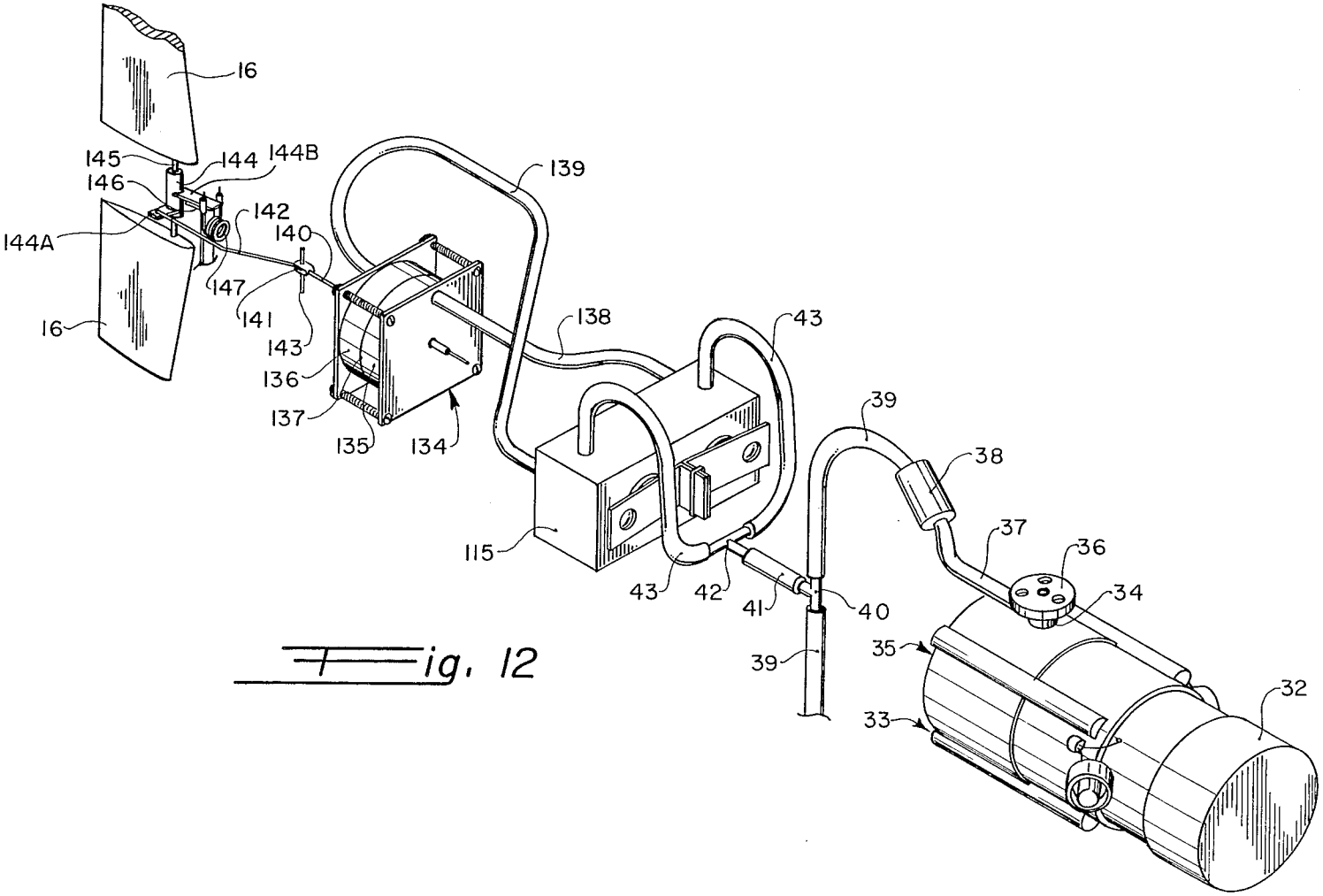
FIG. 12 is a perspective view of that part of the open circuit hydraulic control system positioned rearwardly of the ballast tank.

With additional reference now to FIG. 12, sealed motor/pump housing 32 is provided with a propulsion outlet port 33, a hydraulic outlet port 34 and a pump inlet port 35. Pump inlet port 35 is formed in the rearward portion of the housing 32 and is open to the ambient environment within the hull 11. This port 35 permits water from the hull 11 to be drawn into the centrifugal impeller pump for propulsion, hydraulic and steering purposes as shall be described later.

Hydraulic outlet port 34 is formed in substantially the upper portion of housing 32.

Output from outlet port 34 is directed towards valve 36 which permits the pump to purge itself of air. An internal flap (not shown) closes valve 36 when water impinges on it, but allows air to escape when the pump is off. A first conduit 37 is positioned between the valve 36 and a water filter 38. A second conduit 39 is positioned for fluid communication with its first end secured the opposite side of water filter 38. The second end of conduit 39 is indirectly secured to ballast tank control valve and diving plane control valve for fluid communication therebetween, as shall be discussed later. A first "T" fitting 40 is interposed in the second conduit 39. A third conduit 41 is secured at its one end to the first "T" fitting 40 and at its second, opposite end to a second "T" fitting 42 for fluid communication therebetween. Second "T" fitting 42 is, in turn, interposed in fourth conduit 43 for fluid communication therebetween.

Returning now to FIGS. 2A, 2B, 3A and 3B and with additional reference now to FIG. 4, propulsion outlet port 33 is formed in substantially the lower portion of the housing 32. A propulsion hose 44 is positioned with its first end in fluid communication with port 33 to receive the water being discharged therefrom. With particular reference now to FIG. 4, there is illustrated propulsion venturi/aspirator (ejector pump) 45. Ejector pump 45 is generally cylindrical in shape and is formed having a hollow "hour-glass" shaped interior. Ejector pump 45 is further provided with a first hollow cylindrical neck portion (nozzle) 46 having a first end extending from ejector pump 45 along the longitudinal center line thereof, defining a shoulder therebetween and having a second end which extends into the interior of the pump, terminating therein. Ejector pump 45 is still further provided with a second hollow cylindrical neck portion (suction port) 47 at a position being forward of the second end of nozzle 46, extending vertically-upwardly from the ejector pump 45 perpendicularly to the longitudinal center line and defining a shoulder therebetween. Each of said nozzle, 46 and port 47, are in communication with the hollow interior of the ejector pump 45.

The second opposite end of hose 44 is suitably secured to the nozzle 46, abutting the shoulder. Positioned thusly, propulsion hose 44 provides for fluid communication between the propulsion outlet port 33 and the ejector pump 45.

Returning primarily now to FIGS. 2A, 2B, 3A and 3B, and with additional reference now to FIG. 4, a suction hose (aspirator/venturi hose) 48, having its first end disposed in the lowermost portion 28 of the ballast tank 22, is also secured, at its second opposite end, to the port 47 (abutting the shoulder thereof) of the ejector pump 45 for fluid communication therebetween. This suction hose 48 is further positioned such that its highest portion is in a position being above the water line when the model 10 is surfaced.

Propulsion ejector pump 45 is positioned so as to linearly extend through the rearward portion of the hull 11. In this fashion, hoses 44 and 48 are secured to the ejector pump 45 within the hull 11 while the propulsion exhaust end (port) 45A of said ejector pump 45 is positioned outside thereof. Positioned thusly, water is propulsed through pump 45 via hose 44 and nozzle 46 from the model and into the environment, thereby providing propulsion for movement of the model 10.

With further reference to FIGS. 2A, 2B, 3A and 3B, periscope 13 is provided being positioned forwardly of the ballast tank 22. Periscope 13 doubles as a telescopic vent tube providing air flow to and from the ballast tank 22. A vent hose 49 is positioned between the highest point 29 of the ballast tank 22 and the periscope 13 for carrying air therebetween. As shall be discussed later, water or air drawn from the ballast tank 22 is thereby replaced by air drawn from the atmosphere into the tank 22 via periscope 13 and vent hose 49, respectively, when the top of the periscope 13 is above the surface of the water.

Located in the bow of the model 10 is a multi-channel receiver 50 for receiving radio signal commands dispatched by the operator using a conventional hand held multi-channel transmitter (not shown). This receiver is suitably sealed in a watertight electronic housing 51. An "on board" antenna 52 is positioned extending upwardly from the forward portion of the conning tower 12. The lower portion of this antenna 52 is secured in and supported by an antenna post 53. Antenna post 53 houses a shielded coaxial command signal cable 54 which is positioned between the post 53 and the receiver 50 for radio signal communication therebetween. A radio signal contact spring 55 maintains electrical contact between the antenna 52 and the cable 54. Metal radiator fins 56 extend from the forward end of the receiver 50 into the hull 11. These fins 56 transmit heat from the receiver 50 and its housing 51 to the surrounding water.

Receiver 50 is connected to multipin contacts 57 housed in a watertight connector housing 58 for transmitting the radio signal commands received to the various components of the model 10.

In the forward portion of hull 11, positioned between the conning tower 12 and the connector housing 58 are ballast control valve 59 and diving plane control valve 60 both being in the form of separate solenoid-actuated shuttle valves.

Figure 5:
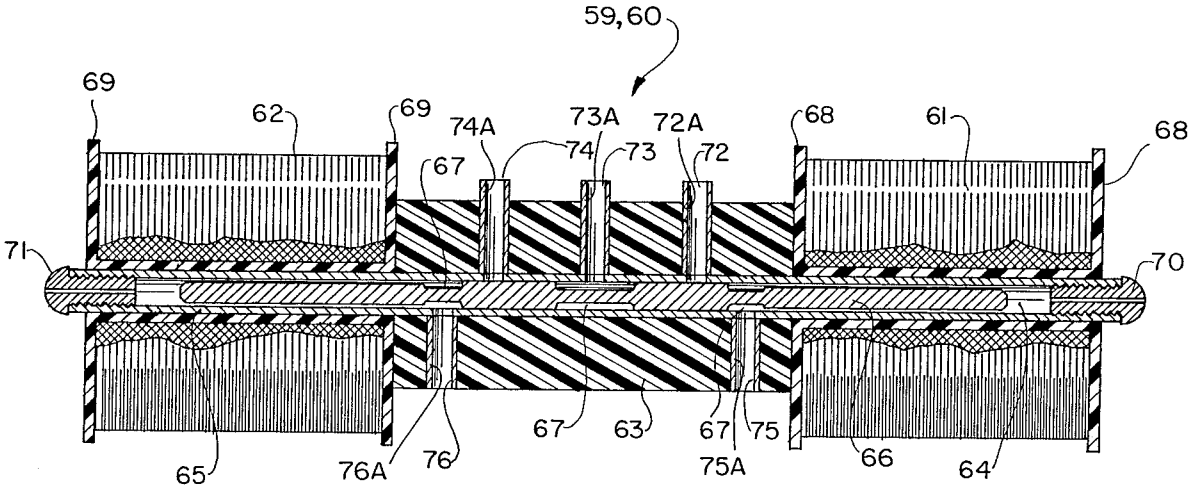
FIG. 5 is a cross-section view of the solenoid-actuated shuttle valves of the present invention.

With particular reference now to FIG. 5, it can be seen that valves 59 and 60 are, preferably, potted in water impermeable resin. Valves 59 and 60 each are provided with a fore coil 61, an aft coil 62 and a central valve portion 63. A bobbin bore (central bore tube) 64 is formed centrally through the coil 59, 60. A central bore bushing bobbin bushing 65 is disposed within the bore 64 and forms the wall of the bore 64 within the valve. Preferably, this bushing 65 is formed of a non-magnetic material and has respective threaded ends. A sliding spool 66 is disposed in the bushing 65 for axial movement therein. Spool 66 is further provided with a plurality of annular grooves 67 formed thereon for purposes as shall be discussed later. In the preferred embodiment, three such annular grooves 67 are provided. Bobbins (Spools) 68 and 69 embrace the coils 61 and 62, respectively. Restraining screws 70 and 71 are disposed through bobbins 68 and 69, respectively, and are received within the bobbin bushing 65, where they engage respectively threaded end portions of bushing 65. Positioned thusly, screws 70 and 71 extends into the bushing 65 thereby limiting movement of the sliding spool 66 therein. The central valve portion 63 is formed with three upwardly extending bores 72, 73 and 74. Each of said bores 72, 73 and 74 has a respective conduit 72A, 73A and 74A disposed therein. Each conduit 72A, 73A and 74A has a respective one end which extends beyond the body of the central housing portion 63 and each of which thereby respectively forms a shoulder therebetween. Each of said conduit 72A, 73A and 74A each respectively, has a second other opposite end which is disposed through bushing 65 being in fluid communication with the bushing 65. Finally, the central housing portion 63 is also formed with two downwardly extending bores 75 and 76 extending through portion 63. Each of said bores 75 and 76 has a respective conduit 75A and 76A disposed therein. Each conduit 75A and 76A has an end which is disposed through bushing 65 being in and providing for fluid communication between the bushing 65 and the ambient environment within the hull 11. These conduits 75A and 76A, positioned in bores 75 and 76 serve as vents to the ambient environment.

Accordingly, and with reference again to FIG. 5 of the drawings, it will be appreciated that when (for example) coil 62 is energized to attract spool 66, such that spool 66 moves to the left when viewed in FIG. 5, the pressurized water flows from bore 73, via one of the external annular grooves 67 formed on the spool 66, to the bore 74 and thence to one side of the diaphragm in the hydraulic actuator; and, simultaneously, the other side of the diaphragm in the hydraulic actuator is vented through its conduit leading to bore 72, via another one of the external annular grooves 67 on the spool 66, and then to ambient through a vent bore 75. A similar flow occurs when the coil 61 is energized to contact the spool 66, the spool 66 moving to the right as viewed in FIG. 5.

Figure 6:
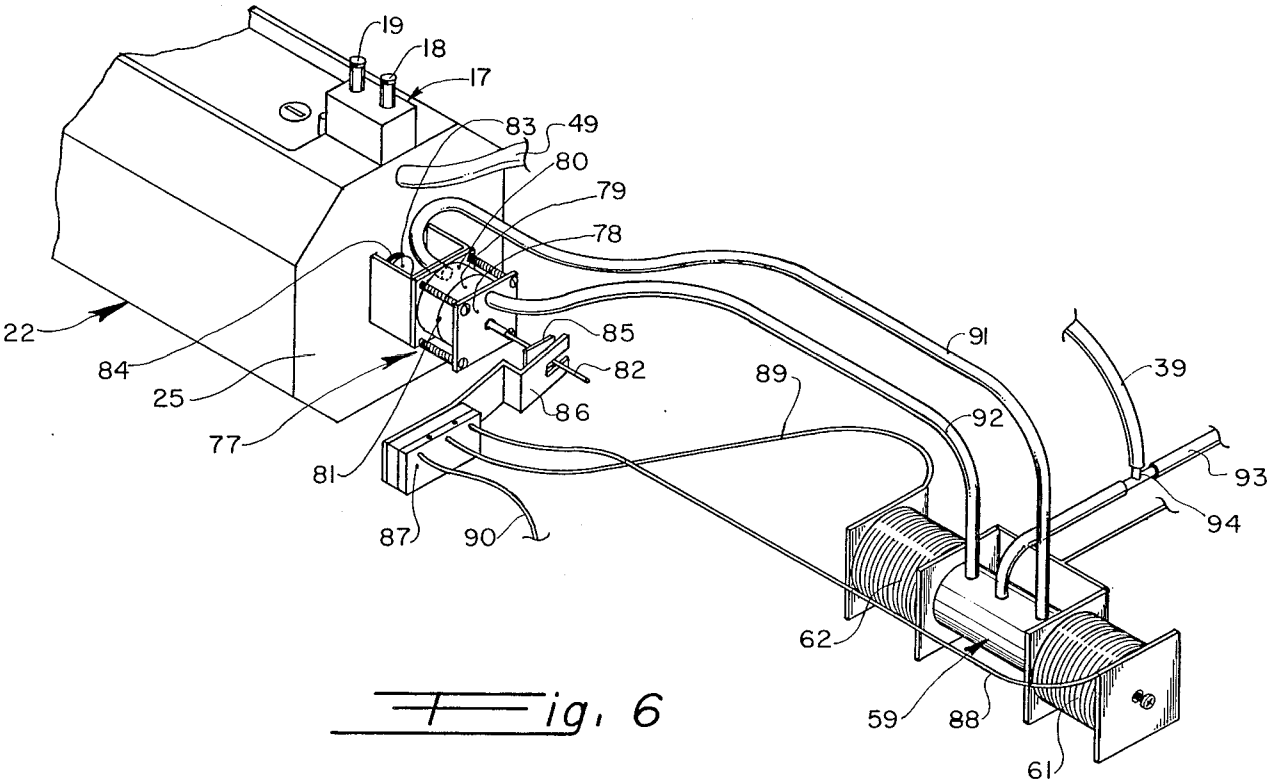
FIG. 6 is a perspective view, with parts broken away, of the ballast tank actuator system removed from the hull for ease of illustration.

Returning now to FIGS. 2A, 2B, 3A and 3B and with further reference now to FIG. 6, a ballast tank actuator 77 is suitably mounted on the forward wall 25 of the ballast tank 22. This actuator 77 is comprised of a housing 78 which houses a forward chamber 79, an aft chamber 80 and an actuator diaphragm 81 therebetween. A shaft 82 is centrally disposed through actuator 77 with its longitudinal axis being positioned perpendicularly to the plane of the diaphragm 81 for movement therewith between a first closed position and a second open position. The shaft 82 has at its rearward end an aperture plug 83 which, when the shaft 82 is in its closed position is seated in aperture 84 formed in the forward wall 25 of the tank 22, thereby blocking the flow of water therethrough. When the shaft 82 is in its second open position, the plug 83 is unseated, whereby the flow of water through aperture 84 into tank 22 is permitted. The shaft 82 further carries at its opposite, forward end a switch actuator 85. When the shaft 82 reaches its fully extended second open position, the switch actuator 85 contacts an elongated arm 86 of a microswitch 87. Microswitch 87 is in turn electrically connected to the fore 61 and aft 62 coils of the ballast control valve 59 by insulated electrical wires 88 and 89 respectively. Microswitch 87 is also electrically connected to the electrical contacts 57 by insulated cable 90.

A fifth conduit 91 is positioned between bore 72 of valve 59 and aft chamber 80 for fluid communication therebetween. A sixth conduit 92 is positioned between bore 74 of valve 59 and fore chamber 79 for fluid communication therebetween. Seventh conduit 93 is positioned between bore 73 of the ballast control valve 59 and bore 73 of the diving control valve 60 for fluid communication therebetween. A third "T" fitting 94 is interposed in seventh conduit 93. Second conduit 39 is positioned between the third "T" fitting 94 and water filter 38 for fluid communication therebetween.

Figure 7:
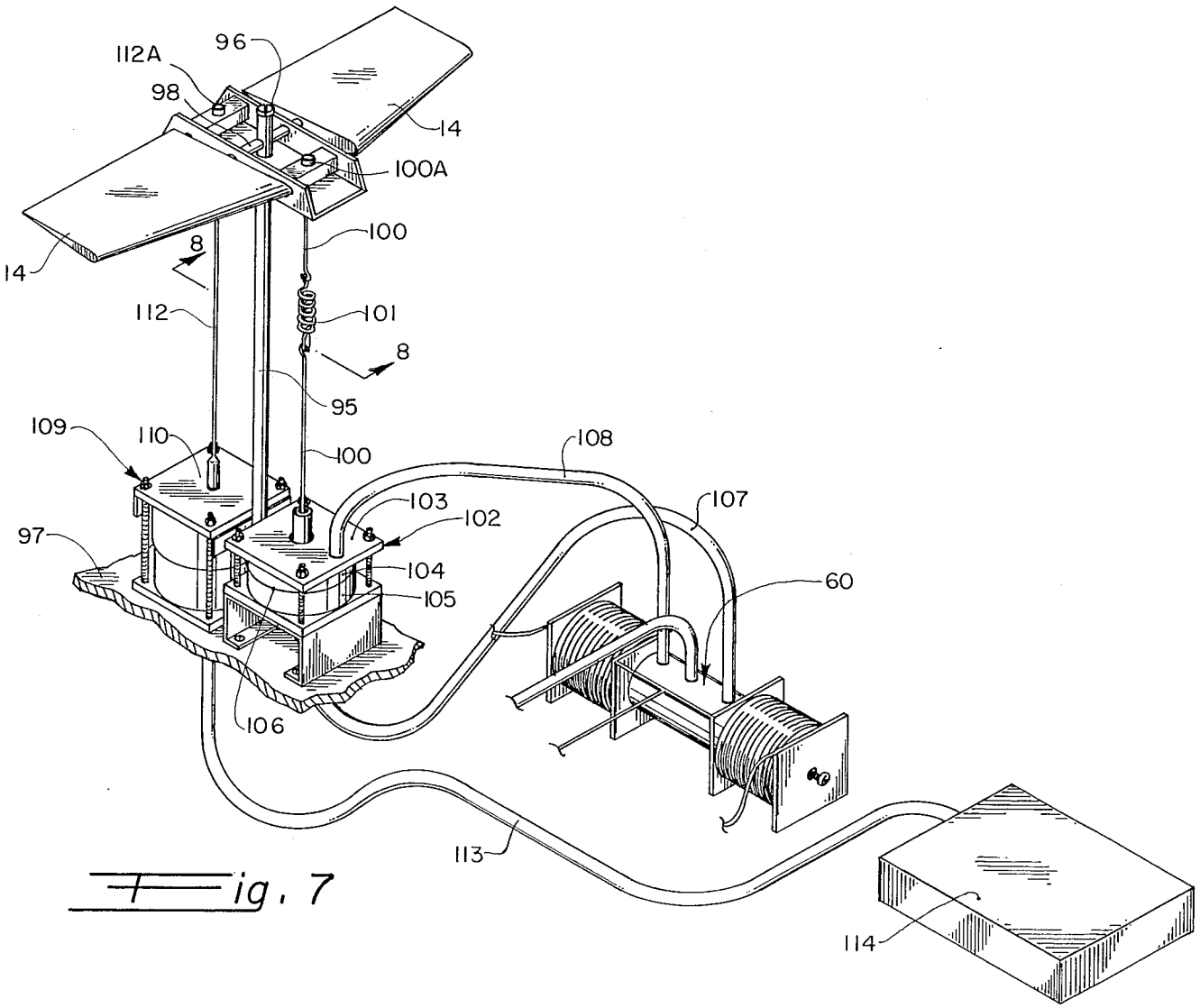
FIG. 7 is a perspective view of the diving plane actuator and automatic depth control systems removed from the hull for ease of illustration.
Figure 8:
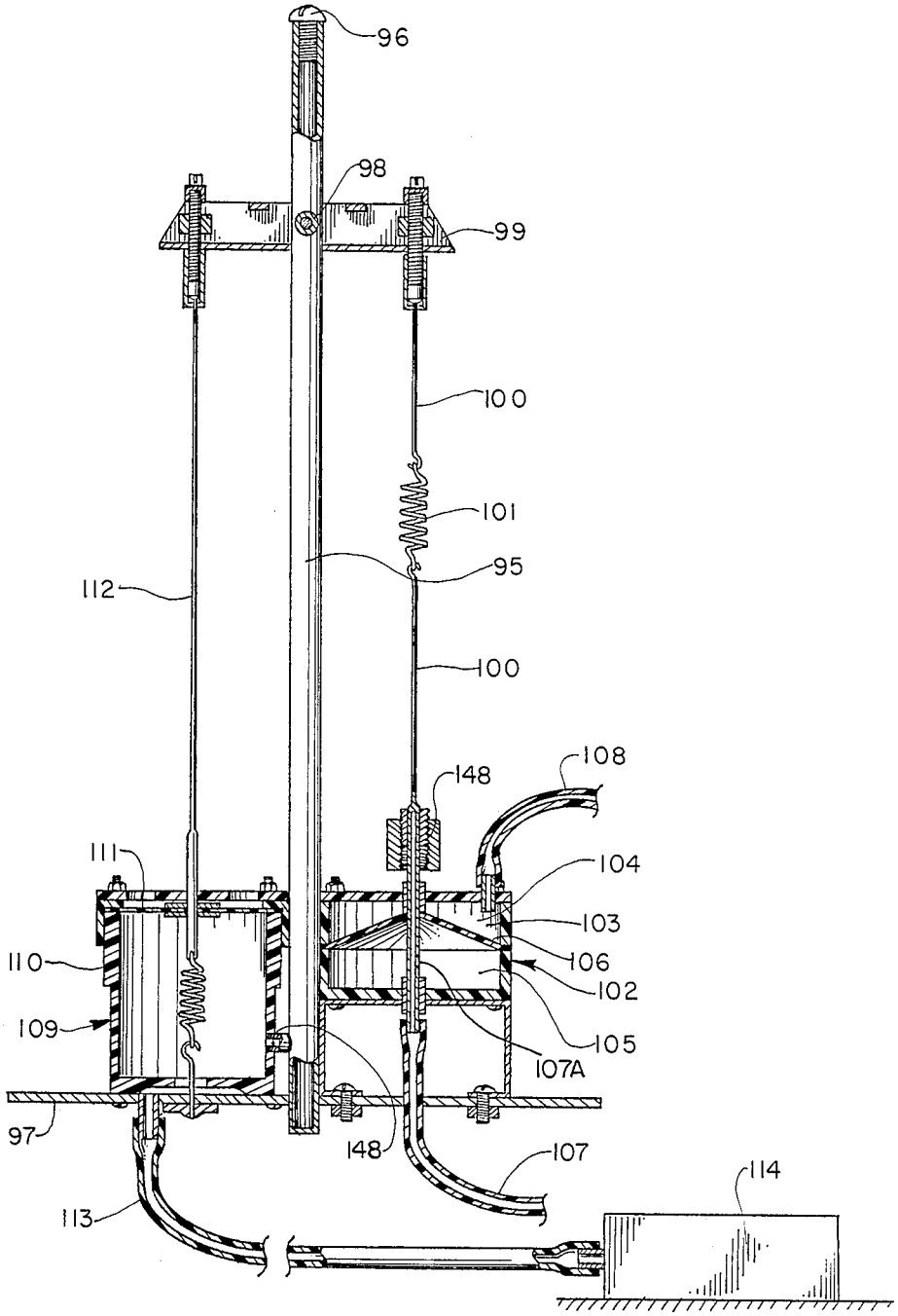
FIG. 8 is a side view, in partial cross-section, taken substantially along lines 8—8 of FIG. 7.

With reference now to FIGS. 7 and 8 in addition to FIGS. 2A, 2B, 3A and 3B, there is illustrated in mechanisms (diving plane actuator systems and the selectively-adjustable, automatic depth control systems) for, inter alia, controlling the forward planes 14 of the model 10. At the top of a hollow tube 95 is located an adjustable seal screw 96. Integral with tube 95 at the opposite end thereof from screw 96 is a base 97 which in turn is suitably secured to the bottom of the hull 11. The automatic depth control mechanism provides for depth control by, in part, the provision of reference air supplied by the atmosphere by opening seal screw 96 and, after the model submarine is placed into water, closing said screw 96. Tube 95 serves as both a vent conduit to the atmosphere for the supply of reference air and a mechanical support for the planes 14. Rotatably carried by tube 95 in substantially the upper portion thereof is a pivot shaft 98. Disposed on the pivot shaft 98 is a diving plane mounting arm 99 (see FIG. 8). Each side of pivot shaft 98 is secured to a respective forward plane 14 for tilting upward and downward movement therewith. Adjustably secured on the forward portion of the diving plane mounting arm 99 is the upper end of a two piece rod 100 having a spring 101 disposed between the two pieces said rod 100 may be adjusted by rotating screw 100A in either a first downward direction, wherein the downward tension is increased, or in a second opposite direction, wherein the downward tension towards the base 97 is decreased.

A diving plane actuator 102 is provided with housing 103 positioned on the forward portion of the base 97. Housed in housing 103 of actuator 102 is upper chamber 104, a lower chamber 105 and a diaphragm 106 positioned therebetween. The lower end of rod 100 is secured within diaphragm 106 for movement therewith. An eighth conduit 107 is positioned between the lower chamber 105 and bore 72 in the diving control valve 60 for fluid communication therebetween. A ninth conduit 108 is positioned between the upper chamber 104 and bore 74 of valve 60 for fluid communication therebetween.

Conduit 107 communicates with chamber 105 (below the diaphragm 106) via a port 107A, as shown in FIG. 8.

A selectively adjustable automatic depth control mechanism or means (diaphragm pressure compensator) 109 is secured on the rearward position of base 97. Depth control mechanism 109 is comprised of a housing 110, a diaphragm 111 within which is secured the lower end of a selectively, adjustable pull rod 112 for movement therewith. Additionally a tenth conduit 113 is positioned between the mechanism 109 and a metal accumulator 114 for air pressure communication therebetween. In this fashion heat transfer between air trapped inside mechanism 109 and the metal accumulator 114 to the ambient water in the hull, is effected. The upper end of rod 112 is secured to the rearward portion of diving plane mounting arm 99. Said rod 112 may be selectively adjusted by rotating screw 112A in either a first direction, wherein tension is increased, or in a second, opposite direction, wherein tension is decreased.

Figure 9:
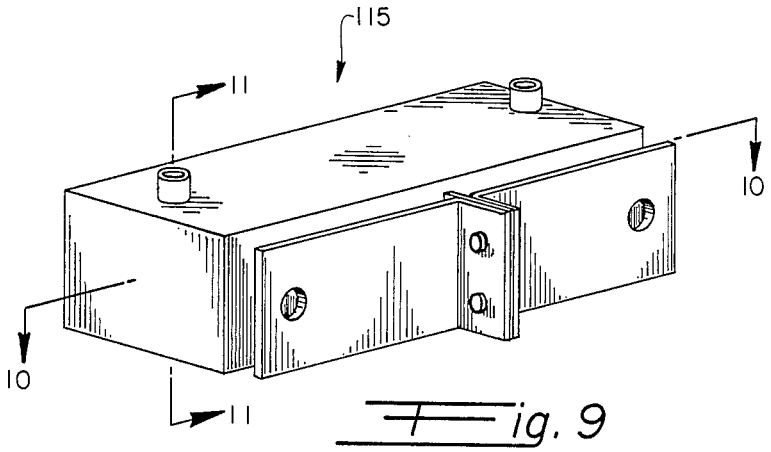
FIG. 9 is a perspective view of the flapper valve.
Figure 10:
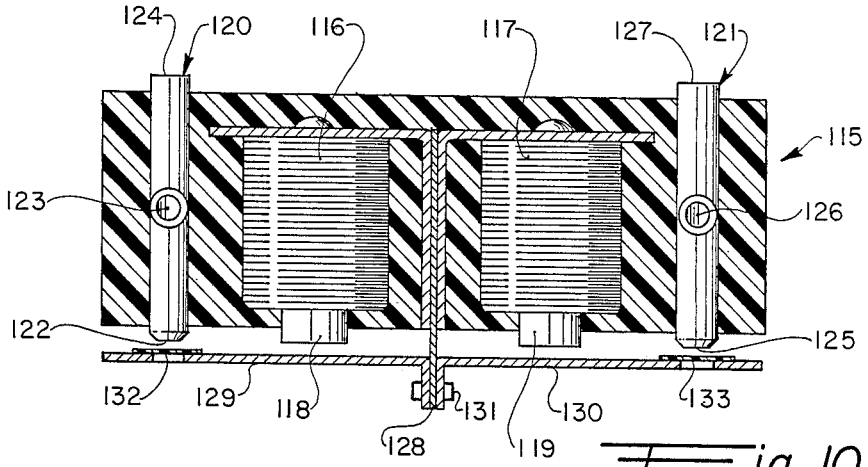
FIG. 10 is a cross-section view of the flapper valve of FIG. 9 taken along line 10—10 of FIG. 9.
Figure 11:
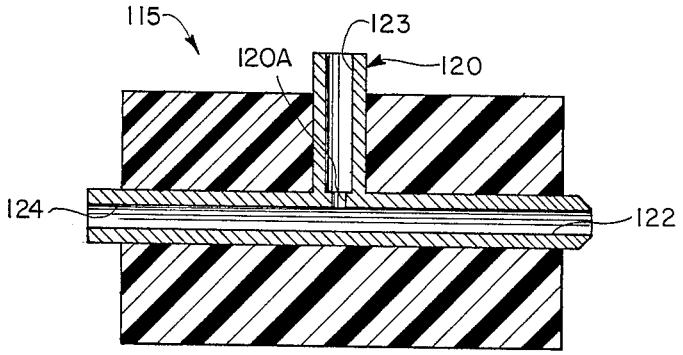
FIG. 11 is another cross-section view of the flapper valve of FIG. 9 taken along line 11—11 of FIG. 9.

Returning now to FIGS. 2A, 2B, 3A, and 3B positioned rearwardly of the pump housing 32 is flapper valve 115. With additional, and with particular reference now to FIGS. 9, 10 and 11, flapper valve 115 can be seen to be formed, preferably, of plastic forming a housing having a left and a right electromagnetic 1200 ohm coil 116 and 117 respectively. Coils 116 and 117 have coil cores 118 and 119 respectively. Said coils 116 and 117 are positioned therein in a side by side relationship. Additionally, a left and a right hollow "T" tube 120 and 121, respectively, are disposed in the flapper valve 115, each respectively being positioned on the far side of either coil 116 or 117, respectively. "T" tube 120 is further positioned so that the ends thereof, having front top and rear ports 122, 123 and 124 respectively, protrude respectively from the front, top and rear of flapper valve 115. "T" tube 121 is further positioned so that the ends thereof having front, top and rear ports 125, 126 and 127, respectively, protrude, respectively from the front, top and rear of flapper valve 115. A fulcrum 128, being, preferably, in the form of a leaf fulcrum (leaf spring) is provided. Fulcrum 128 is fabricated of magnetically permeable metal and magnetically connects the coils 116 and 117. Said fulcrum 128 extends from the forward face of the valve 115. A pair of flappers 129 and 130 are pivotably secured, respectively to the left and right sides of the fulcrum 128 by rivets 131. Each flapper 129 and 130 is positioned so as to extend in the direction of "T" tubes 120 and 121 respectively. Each flapper 129 and 130 carries a rubber seal, 132 and 133 respectively. Positioned thusly, upon either flapper 129 or 130 being attracted towards its respective coil 116 or 11, a respective rubber seal 132 or 133 thereon will be drawn towards, will contact and will block the corresponding front port 122 and 125 of the respective "T" tubes 120 and 121 aligned therewith. Front ports 122 and 125 are each formed having a reduced diameter to restrict the flow of water therethrough. Between top port 123 (or 126) and front port 122 (or 125) of T-tube 120 (or 121), there is a reduced diameter orifice 120A, as clearly shown in FIG. 11 of the drawings.

Returning now to FIG. 12, a fourth conduit 43 is secured at its one end to top port 123 of left "T" tube 120 and, at its other, opposite end to top port 126 of right "T" tube 121 for fluid communication therebetween. Positioned rearwardly of flapper valve 115 is a steering (rudder) actuator 134. Steering actuator 134 includes, inter alia, a forward chamber 135 a rearward chamber 136 and a steering diaphragm 137 positioned therebetween.

An eleventh conduit 138 is positioned between the forward chamber 135 and rear port 127 of "T" tube 121 for fluid communication therebetween. A twelfth conduit 139 is positioned between the rearward chamber 136 and rear port 124 of "T" tube 120 for fluid communication therebetween.

Centrally disposed through actuator 134 with its longitudinal axis being positioned perpendicular to the vertical plane of said actuator 134 is a forward steering rod 140. Forward steering rod 140 is suitably secured by appropriate means to diaphragm 137 for axial movement therewith. The rearward end of rod 140 is formed so as to comprise a U-joint 141.

A rearward steering rod 142 is provided with its forward end being suitably secured by pin 143 to the U-joint 141 at the rearward end of rod 140 for movement therewith. The rearward end of rearward steering rod 142 is suitably secured to a first arm 144A of an "L" shaped sleeve 144.

A steering shaft 145 is disposed through the rearward portion of the hull 11 on a vertical axis being substantially perpendicular to the longitudinal axis of the model. Shaft 145 carries at both ends thereof, rudders 16 for movement therewith. Steering shaft 145 carries sleeve 144 thereon. Movement of the second arm 144B of the sleeve 144 is restricted by a spring mounting bracket 146. Carried by spring mounting bracket is torsion spring 147. Said torsion spring 147 acts to restrict movement of arm 144B by constantly urging and maintaining the second arm of the torque sleeve 144 on a longitudinal axis being substantially parallel to the longitudinal axis of the hull 11.

Having thus discussed the mechanical structure of the model the operation of said model will be mechanically understood and appreciated.

First, screws 100A and 112A are selectively adjusted to, respectively set the tension at which the actuator 102 will drive the diving planes 14 and to set the lowest depth at which it is desired for the model to operate then, the model 10 is placed in water without motor pump running. Next, seal screw 96 is opened allowing reference air to fill tubes 95, 148 and 113, as well as, chamber 110 and accumulator 114. Once reference air is admitted, the screw 96 is closed trapping therein the reference air needed to operate the automatic depth control mechanism 109.

The power system of the model 10 is then activated by the operator switching "on" switches 18 and 19. This closes the circuit between the batteries 30 and powers the motor pump unit and the receiver 50.

When the model 10 is thus initially placed in the water, due to the overall buoyancy of the model, with the ballast tank 22 empty (of water) it will rest and/or cruise on the surface. At this time, the ballast tank aperture plug 83 is in its seated position, wherein entry of water into the ballast tank 22 is prevented. Immediately upon placement in the water, the free flooding hull 11 will begin to fill with water entering the hull from the environment via apertures 20. Air being displaced by the incoming water may escape via the apertures 20 located in the top portion of the hull 11.

Control of the model 10, while it is in the water is provided by radio signals from a hand held radio transmitter operated by the user which is sent to the multichannel receiver 50. Radio signals transmitted from the transmitter are initially received by an "on-board" antenna 52, and are transmitted via spring contact 55 to the command signal cable 54 which carries the signal to the receiver 50. The receiver 50, in turn, sends appropriate signals via contacts 57 to the valves 59, 60 and 115.

Propulsion (as well as several other functions to be discussed later) is provided to the model 10 by the motor-pump unit. The centrifugal pump draws ambient water into the hull 11 and into the pump via pump inlet port 35. This ambient water is pressurized and expelled through propulsion outlet port 33, and propulsion hose 44 and into the aspirator/venturi 45. As fluid from hose 44 moves through the venturi 45 toward its discharge end 45A, a vacuum is created in the port 47 which, in turn, creates a vacuum (negative pressure) in hose 48 which, in turn, draws either liquid or air out from the inside of the ballast tank 22, at a first rate through hose 48 and port 47 and into the venturi 45 where it mixes with pressurized water from hose 44 and is discharged from the model 10 therewith. Air of liquid drawn from the inside of the ballast tank 22 is replaced with either air vented into the ballast tank 22 via periscope 13 and vent hose 49 respectively or with water if the top of the periscope 13 is submerged. If aperture plug 83 is spaced from aperture 84, water will enter the tank 22 at a rate greater than the rate at which pump 45 can remove water from the tank 22, thereby permitting the ballast tank 22 to fill with water and allowing the vessel to submerge. When the motor is at operating speed, a vacuum of approximately 29 inches of water is created inside the aspirator 45.

Buoyancy is controlled via emptying and filling of the ballast tank 22. When the ballast tank 22 is empty the suction hose 48 draws air from the bottommost point 28 of ballast tank 22 and carries the air to venturi 45 where it is mixed with pressurized water from hose 44 and is ejected under pressure from the venturi 45 therewith. Air drawn from the ballast tank 22 is replaced by air from the atmosphere, drawn through the periscope 13 which doubles as a telescopic vent tube connected by a vent hose 49 to the highestmost point 29 of the ballast tank 22.

With the motor on, the venturi hose 48 always draws water or air from the lowest most point 28 of the ballast tank 22. The venturi hose 48 is installed such that its highest most point is above the water line when the model is surfaced. This prevents water from siphoning back into the ballast tank 22 from the venturi 45 when the model is surfaced and the pump is not running. In this fashion, the ballast tank is continuously purged. This provides the operational advantage of simplicity in that the pump does not have to be reprimed after purging (for surfacing operations) and further that less complicated devices may be utilized which decreases overall costs of fabrication and maintenance of the model.

To dive to "periscope" depth, the appropriate radio signal from the user's transmitter is sent to the multichannel receiver 50. The receiver 50 in turn, sends a momentary signal to the aft coil 62 of the ballast control valve 59, whose full operation will be explained below. Energizing the aft coil 62 causes a spool 66 in this valve 59 to shift to the aft position where it will remain until the fore coil 61 is energized.

As will be appreciated, the "spool" 66 constitutes a magnetically-controlled slide of a solenoid-actuated shuttle valve 59.

With the spool 66 in the aft position, filtered water from outlet port 34 positioned in the housing 32 (FIG. 3A) of the pump is directed to the aft chamber 80 of the ballast tank actuator 77 where approximately 3 p.s.i.g. of water pressure drives the ballast tank actuator diaphragm 81 forward moving shaft 82 from its first, closed position and into its second, open position, thereby unseating the ballast tank aperture plug 83 from the aperture 84. With aperture 84 open, water from the forward chamber 79 of the ballast tank actuator 77 escapes to the ambient environment in the hull 11 through downwardly extending bores 75 and 76 formed in the ballast control valve 59. With the ballast tank aperture plug 83 open, water floods the ballast tank 22 at a second, greater rate being faster than it is being purged by the venturi action of the aspirator 45. The sloped roof 24 of the ballast tank 22 assures that the ballast tank 22 floods completely. Air is vented to the atmosphere via the vent hose 49 and periscope 13.

When the fore coil 61 of the ballast control valve 59 is actuated, the spool 66 shifts to the forward end, whereupon pressurized water is directed to the forward chamber 79 of the ballast tank actuator 77 via sixth conduit 92. This reseats the ballast tank aperture plug 83. Now the continuous action of the venturi 45 draws water from the ballast tank 22. So long as the periscope 13 is exposed to the atmosphere, air will be drawn into the ballast tank 22 via vent hose 49. This will raise the model from "periscope" depth to full surface.

Radio control of the ballast system is simplified by introducing a microswitch 87, which when activated, switches the polarity of coils 61 and 62. Retraction of the ballast tank aperture plug 83 causes the shaft 82 carrying aperture plug 83 at its second end and a switch actuator 85 to trip the microswitch 87. This causes a reversal of the polarity of the coils 61 and 62 through a diode block in the ballast control valve 59 so that a signal identical to that which causes opening of the ballast aperture plug 83 also causes the closing of said aperture plug 83 upon the subsequent transmission.

Further diving below periscope depth is accomplished by the forward planes 14 located on the conning tower 12. Initially, the submarine model is placed in the water with the power off. The diving plane control system is equilibriated by opening the seal screw 96 which leads to a tube 95 which serves both as a vent to the atmosphere and a mechanical support for the planes. With the seal screw 96 loosened, air at atmospheric pressure is admitted from tube 95 to the lower section of mechanism 109 via connecting tube 148. Accumulator chamber 114, which is preferably fabricated from a metal having high thermal conductivity and which also adds additional reference air volume for sensitivity, forms a part of the depth control system. After a few minutes in the water, the mechanism 109 has achieved thermal and barometric equilibrium with the surrounding water and ambient air respectively and the depth control system may be sealed by tightening the seal screw 96.

The diving mode begins by starting the electric motor. With the ballast tank aperture plug 83 closed, the venturi 45 via hose 48 will draw air from the ballast tank 22 as the model is fully buoyant. A radio signal from the operator activates the ballast tank actuator 59 which then floods the ballast tank 22 with water at a greater rate than water can be removed by the venturi 45. With the ballast tank 22 flooded, the model reaches periscope depth, that is, only the periscope-vent 13 and antenna 52 are visible above the water surface.

The "periscope depth" of the submarine 10 is herein defined as that depth when only the periscope of the submarine is disposed above the surface of the water. When an appropriate command signal has been given, the articulatable diving planes 14 become dynamic; and the submarine 10 will submerge to its desired predetermined depth. The mechanism 109 and the diving plane actuator 102 are balanced so that at periscope depth, the forward planes 14 are horizontal (zero angle of attack). Should the model exceed equilibrium periscope depth, the higher ambient water pressure in the surrounding water will have the effect of distending the diaphragm 111 downwardly. This causes the forward planes 14 to tilt upwardly, restoring the model to periscope depth. Any surfacing tendency is similarly compensated by the mechanism 109. The net effect is that the model 10 is capable of achieving and maintaining a pre-set depth with no operator input other than the initial command to flood the ballast tank 22.

To dive deeper than periscope level requires operator input to a diving control valve 60 in the form of a radio diving signal. The diving control valve 60 functions like the ballast control valve 59. When the on-board receiver 50 detects the radio diving signal it activates the sliding spool 66 on the diving plane control valve 60 which causes water from the hydraulic system to be directed via ninth conduit 108 to the upper chamber 104 of the diving plane actuator 102. This causes extension of the actuator diaphragm 106 downwardly and concomitant downward extension of the spring 101 which tilts planes 14 downwardly into a negative angle of attack which results in diving. As the model dives, the increase of water pressure acting on the depth control mechanism 109 will cause the return of the forward planes 14 to a horizontal position. The model will automatically hold this deeper depth via mechanism 109 action until either another signal is received or until forward speed is lost. Since, as was stated earlier, the model is slightly positively buoyant, the loss of forward speed from, i.e., cessation of operation of the pump or from striking a stationary object, reduces the dynamic forces or the planes 14 to zero, causing the model to surface to at least periscope depth.

A "rise" signal from the operator will cause activation of the sliding spool 66 on the diving control valve 60. This sends water to the lower chamber 105 of the diving plane actuator 102. This distends the actuator diaphragm 106 upwardly causing planes 14 to tilt upwardly to a positive angle of attack. A threaded sleeve 149 can be raised or lowered on the rod 100 which connects the actuator diaphragm 106 to the spring 101. The position of this sleeve 149 aids in determining the depth limit of the model 10 by limiting the extent to which the actuator diaphragm 106 can be distended downwardly by the entry of water into the upper chamber 104.

As shown more clearly in FIG. 8, the sleeve 149 (threadably carried by the vertical push-pull rod 100) will engage the top wall of the hydraulic actuator 102, thereby limiting the downward movement of the push-pull rod 100, thereby limiting the angular movement of the pivot arm 99, and thereby limiting the negative angle of attack of the articulatable forward diving planes 14. Thereafter, the function of the air reference actuator 109, wherein ambient water may enter through openings in the top wall of the reference actuator 109 to impinge upon the diaphragm 111 as clearly shown in FIG. 8, provides a counterforce generated by the water pressure which increases substantially in proportion to the increasing depth to which the boat is submerged; and this counterforce, together with the tension springs, tends to move the second vertical (connecting) rod 112 upwardly to pivot the pivot arm 99 in an opposite direction, thereby rotating the articulatable forward diving planes 14 back towards their neutral angle of attack, and thereby leveling off the boat at the selected desired depth, as predetermined by the adjusted position of the threaded sleeve 149 on the push-pull rod 100.

Steering is provided by water being selectively diverted into either the forward chamber 135 (if a left-hand turn is desired) or the rearward chamber 136 (if a righthand turn is desired) of the steering actuator 134 by a radio signal from the operator. This radio signal is received by the receiver 50 which activates either the left coil 116 or the right coil 117 of a flapper valve 115. Activating either 1200 ohm coil 116 or 117 causes a corresponding flapper 129 or 130 having a rubber seal (132 and 133 respectively) thereon to be attracted thereto. Since the flapper 129, and 130 are, respectively pivoted on the fulcrum 128, the rubber seal 132, and 133, respectively, carried thereon are drawn towards a corresponding front port 122, and 125, respectively, of a corresponding hollow "T" tube 120 and 121, respectively. Normally, water is pumped into the "T" tubes 120 and 121 via top ports 123 and 126 respectively. The water in the "T" tubes 120, 121 then can flow from said tubes 120, 121 via rear ports 124 and 127 respectively and front ports 122 and 125 respectively where it is received in hoses 139 and 138 respectively. However, when either particular front port 122, 125 is closed, the water will be forced out through its corresponding rear port 124, and 127 respectively and into the appropriate hose 138 and 139, respectively, which carries it to the steering actuator 134 resulting in movement of the rudders 16.

For example, when a left turn radio signal is sent to the receiver 50, the left coil 116 of flapper valve 115 is activated. Activating the left 1200 ohm coil 116 causes the flapper 129 to be attracted by the left coil 116. Due to obstruction of front port 122, by the seal 132, the hydraulic output of the pump is directed through left hose 139 and into the rearward chamber 136 of the steering actuator 134.

The "T" tubes 120, 121 are actually embedded in the flapper valve 115 in which the coils 116 and 117 are also embedded. The opening between top ports 123 and 126, respectively, and the front and back ports within the tubes 120 and 121 each terminate in a 0.010 inch diameter orifice. The body of the T-tube 120, 121 has at the front port 122 and 125, respectively, a 0.032 inch diameter orifice. Water is introduced to the top ports 123 and 126 at about 3 p.s.i.g. The 0.101 inch diameter orifice, located between top ports 123 and 126 and the front and back ports, restricts the flow of water into the flapper valve 115 to about 15 cubic centimeters per minute. This flow exits front ports 122 and 125 if the flappers 129 and 130 are de-activated. When the respective flappers 129 or 130 are sequentially activated, the respective seal 132 or 133 thereon (a 0.010 inch thick pad) is brought into contact with a respective front port 122 and 125, thereby forcing the flow out the respective "T" outlet 120 and 121 through rear ports 124 and 127, respectively, and into the hoses 139 or 138 respectively, and to the appropriate chamber (either 136 or 135 respectively) of the steering activator 134.

Output from the motor-pump unit provides thrust for propulsion and suction for ballast evacuation. In addition, hydraulic outlet port 34, supplies the hydraulic flow necessary to activate the ballast tank actuator 77, diving plane actuator 102 and steering actuator 134. Other actuators could be supplied as well. The output from the port 34 is directed towards a check valve 36 which closes said valve after air was relieved from the pump housing and before the pump is turned on. After pressurized water exits the valve 36 assembly through a first conduit 37 it enters a water filter 38. The filtered output of water is then directed to the various actuators where the pressurized water may either be used to do work or vented.

Figure 14:
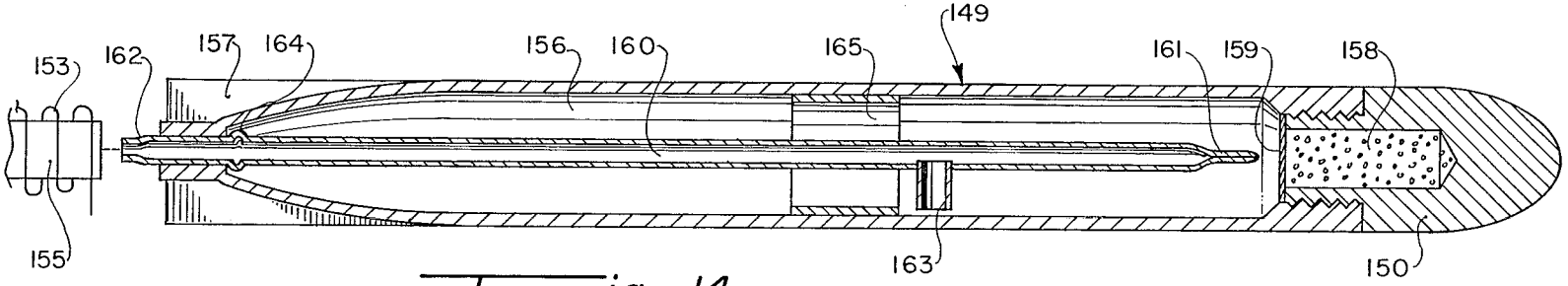
FIG. 14 is a side view, in cross-section, of a torpedo of the present invention.
Figure 13:
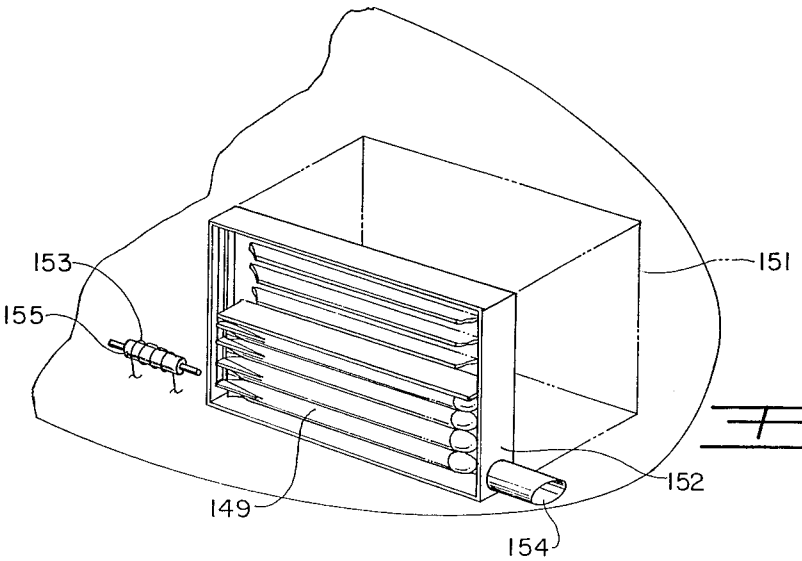
FIG. 13 is a perspective view, in partial cross-section, of the forward portion of the hull showing the torpedo magazine mounted therein.

With reference now to FIGS. 13 and 14 the torpedo firing system which may be incorporated into the model submarine is illustrated. This system may be located to the side of or in front of the radio receiver housing 50 as seen in FIG. 13. FIG. 14 shows an individual torpedo 149. The torpedo 149 is propelled by a jet of pressurized water which receives its impetus from a chemical evolution of carbon dioxide gas. The parts of the torpedo 149 are designed so that when it is completely filled with water and the threaded nose cone 150 is in place, the torpedo is neutrally buoyant. Being neutrally buoyant, the torpedo will have no adverse affect on the trim of the submarine while it is housed in a free flooding torpedo tube or magazine within the hull of the submarine. FIG. 13 shows a magazine 151 similar to that used in an automatic rifle. The torpedos 149 are stacked like bullets. The magazine housing 152 contains a plurality of torpedos 149 which are biased by firing spring 153 downward towards a firing tube 154 located at the bottom. A solenoid 155, when energized will move forward to fire the bottommost torpedo 149.

FIG. 14 shows a torpedo 149 is comprised of a main body 156 with integral stabilizing fins 157. A cavity 158 is filled with a mixture of baking soda and citric or other acid powder. A thin aluminum membrane 159 seals the cavity to keep the powder hermetically sealed. A plunger tube 160 having a sharp point 161 on one end and a converging nozzle 162 at the other end serves as a firing pin when it is forced through the membrane 159 by the solenoid 155 thereby exposing the powder to the water contained in the main cavity 156. Carbon dioxide which is then produced forces the water in the main cavity into port 163 into tube 160 and through nozzle 162. The lip 164 in tube 160 serves both as a seal to the torpedo housing and prevents the pressure from pushing tube 160 out of the torpedo housing. As carbon dioxide builds up in the top of the torpedo housing and the water volume in same diminishes, the torpedo 149 becomes positively buoyant. As such, it will rise to the surface immediately after firing and will skim along at the surface interface. When the water and carbon dioxide is spent in the torpedo 149 will float on the surface awaiting retrieval.

A metal band 165 of magnetically permeable material is either located inside or is formed as part of a plastic housing. A pair of permanent magnets (not shown), one on each side of the hull of the submarine and located at the water line, may be used to attract and hole the floating torpedos as the submarine is maneuvered along side. Retrieval is accomplished in this manner with the submarine fully surfaced.

The same torpedo 149 shown in FIG. 14 can become a missile fired from a vertical tube by eliminating port 163 and instead, incorporating a hole or holes just forward from the lip 164. The torpedo 149 version in FIG. 14 must be loaded into the magazine 151 with tube 160 facing downward so that the bulk of the water in cavity 158 is expelled before carbon dioxide can escape. The missile version has no loading restriction other than being stored and fired in the vertical position. Just as with the torpedos, the missile holding magazine and one launching tube can be utilized, except it is mounted vertically within the hull.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In a positively buoyant model submarine of the type having forward planes, stern planes and rudders, the improvement thereupon, in combination, comprising: a free flooding hull; a hydraulic propulsion means having a hydraulic discharge; the hydraulic propulsion means including a ballast tank for receiving fluid therein; an aspirator means secured between the ballast tank and the hydraulic propulsion means; said tank being continuously purged of fluid therein at a first rate by the hydraulic discharge of the propulsion means; a ballast tank flooding means for selectively flooding the ballast tank with fluid at a second rate being greater than the first rate, wherein by controlled flooding and purging of the ballast tank, submerging of the model submarine to its periscope depth is achieved; and an open circuit hydraulic control system means positioned within the hull for controlling the ballast tank flooding means; movement of the forward planes and movement of the rudders, wherein the hydraulic pump is further formed having a hydraulic outlet port therein for discharging fluid from the pump in a controlled fluid stream and wherein the open circuit hydraulic control system means is comprised of: a diving plane control valve having a fore magnetic coil, an aft magnetic coil and a central valve portion disposed therebetween, said valve being further provided with a central bore tube formed through said valve, said bore tube having a first fore end and a second aft end; a central bore tube bushing being disposed in and lining the bore tube; a metal sliding spool being disposed in the bore tube for axial movement therein, said spool being formed with a plurality of annular grooves thereon; a first and a second bobbin positioned embracing the fore coil and the aft coil respectively; a first retaining screw disposed through the first bobbin and being received in the first fore end of the bore tube; a second retaining screw disposed through the second bobbin and being received in the second aft end of the bore tube, whereby first and second restraining screws restrain the spool in the bar; a first upwardly extending bore being formed in the valve in fluid communication with the bore tube, a third bore and the upper chamber of the diving actuator for fluid communication therebetween, whereby liquid flowing from the diving actuator valve to the upper chamber, fills said chamber expanding the diaphragm, carrying the shaft into its second lowered position.

2. The model of claim 1, further comprising: a microswitch actuator means; and a microswitch being electrically connected to the fore coil and the aft coil of the diving plane valve, said microswitch being positioned to contact the microswitch actuator means, wherein when said fore coil is energized, contact of the microswitch by the microswitch actuator means energizes the aft coil and de-energizes the fore coil and vice versa.

3. In a positively buoyant model submarine of the type having forward planes, stern planes and rudders, the improvement thereupon, in combination, comprising: a free flooding hull; a hydraulic propulsion means having a hydraulic discharge; the hydraulic propulsion means including a ballast tank for receiving fluid therein; an aspirator means secured between the ballast tank and the hydraulic propulsion means; said tank being continuously purged of fluid therein at a first rate by the hydraulic discharge of the propulsion means; a ballast tank flooding means for selectively flooding the ballast tank with fluid at a second rate being greater than the first rate, wherein by controlled flooding and purging of the ballast tank, submerging of the model submarine to its periscope depth is achieved; and an open circuit hydraulic control system means positioned within the hull for controlling the ballast tank flooding means; movement of the forward planes and movement of the rudders, wherein the hydraulic propulsion means comprises: a battery positioned coincident the center of buoyancy of the ballast tank; a sealed housing; a hydraulic pump positioned in the sealed housing; an electric motor positioned in the sealed housing; means for electrically connecting the battery to the motor, wherein the battery supplies power to the motor; means for receiving the fluid stream being discharged from the pump and for directing said fluid stream out of the model, whereby propulsion of the model is provided; said pump having a pump inlet port formed therein for fluid communication between the ambient environment within the hull and the pump, and further having a propulsion outlet port formed therein for discharging fluid from the pump in a fluid stream, wherein the hydraulic pump is further formed having a hydraulic outlet port therein for discharging fluid from the pump in a controlled fluid stream and wherein the open circuit hydraulic system means for controlling movement of the rudders is comprised of: a valve means having a first and a second outlet ports and further having an inlet port; a first conduit means positioned between the hydraulic outlet port and the valve means for fluid communication therebetween, whereby fluid is supplied to said valve means; a steering actuator having a fore chamber, an aft chamber and a steering diaphragm positioned, a steering rod having a fore end and an aft end being centrally disposed through the steering actuator and carried at its fore end by the diaphragm with its longitudinal axis being positioned perpendicular to and carried by the diaphragm for movement therewith between a first forward position and a second rearward position; a rudder shaft being suitably secured to the aft end of the steering rod for movement therewith, said rudder shaft having a rudder disposed at either end thereof for left and right movement therewith, wherein in its first forward position, the steering rod rotates the rudder shaft simultaneously moving the rudders to the left and further, wherein in its second rearward position, the steering rod rotates the rudder shaft simultaneously moving the rudders to the right; a second conduit means positioned between the valve means and the fore chamber of the steering actuator for fluid communication therebetween, whereby liquid flowing from the valve means to the fore chamber fills said chamber expanding the diaphragm carrying the steering rod into its second rearward position; a third conduit means positioned between the valve means and the aft chamber of the steering actuator for fluid communication therebetween, whereby liquid flowing from the valve means to the aft chamber fills said chamber, expanding the diaphragm carrying the steering rod into its first forward position.

4. A model submarine, comprising a free-flooding hull having at least one water inlet vent hole formed therein, the hull including fore, aft and mid sections, respectively, a ballast tank in the mid section of the hull, the ballast tank having an inlet valve and further having a drain port, a single motor-pump unit in the aft section of the hull, the motor-pump unit including a motor and further having a main discharge port and a subsidiary discharge port, a battery confined within the bounds of the ballast tank for energizing the motor, a discharge pipe mounted on the aft section of the hull and extending therethrough, means including an aspirator and a nozzle for connecting the discharge pipe to the main discharge of the pump, thereby drawing water out of the drain port of the ballast tank and through the pump and out of the nozzle, thereby providing a pressurized discharge for the main propulsion of the submarine, an articulatable rudder on the aft section of the hull, an electrically-responsive first hydraulic valve means in the aft section of the hull and connected to the subsidiary discharge of the pump, first hydraulically-responsive means connecting the first hydraulic valve means to the rudder, thereby providing for steering control, a second hydraulic valve means in the fore section of the hull and connected to the subsidiary discharge of the pump, second hydraulically-responsive means connecting the second hydraulic valve means to the inlet valve in the ballast tank, thereby controlling the flooding of the ballast tank and the depth to which the submarine may submerge, an articulatable diving plane mounted on the fore section of the hull, a third hydraulic valve means in the fore section of the hull and connected to the subsidiary discharge of the pump, third hydraulically-responsive means connecting the third hydraulic valve means to the articulatable diving plane, thereby controlling the attitude of the submarine in the water, each of the first, second and third hydraulic valve means using ambient water for this actuation and being responsive to electrical signals, respectively, and a receiver in the hull for accepting command signals from a remote source and generating the respective electrical signals for controlling the submarine through the first, second and third hydraulic valve means, respectively.

5. In a positively buoyant model submarine of the type having forward planes, stern planes and rudders, the improvement thereupon, in combination, comprising: a free flooding hull; a hydraulic propulsion means having a hydraulic discharge; the hydraulic propulsion means including a ballast tank for receiving fluid therein; an aspirator means secured between the ballast tank and the hydraulic propulsion means; said tank being continuously purged of fluid therein at a first rate by the hydraulic discharge of the propulsion means; a ballast tank flooding means for selectively flooding the ballast tank with fluid at a second rate being greater than the first rate, wherein by controlled flooding and purging of the ballast tank, controlled submerging of the model submarine to its periscope depth is achieved; and an open circuit hydraulic control system means positioned within the hull for controlling the ballast tank flooding means; movement of the forward planes and movement of the rudders, wherein the hydraulic propulsion means comprises: a battery positioned coincident the center of buoyancy of the ballast tank; a sealed housing; a hydraulic pump positioned in the sealed housing; an electric motor positioned in the sealed housing; means for electrically connecting the battery to the motor, wherein the battery supplies power to the motor; means for receiving the fluid stream being discharged from the pump and for directing said fluid stream out of the model, whereby propulsion of the model is provided; said pump having a pump inlet port formed therein for fluid communication between the ambient environment within the hull and the pump, and further having a propulsion outlet port formed therein for discharging fluids from the pump in a fluid stream, wherein the ballast tank flooding means is further comprised of: the ballast tank being provided with a highestmost point, said tank further having an aperture formed therein, said aperture providing for fluid communication between the ballast tank and the ambient environment within the hull; a conduit positioned between the ballast tank and the outside environment for providing fluid communication therebetween; and a ballast tank actuator means for selectively blocking and unblocking the aperture, whereby flooding of the ballast tank is controlled, wherein the hydraulic pump is further formed having a hydraulic outlet port therein for discharging fluid from the pump in a controlled fluid stream, and wherein the open circuit hydraulic control system means is comprised of: a ballast tank control valve having a fore magnetic coil, an aft magnetic coil and a central valve portion disposed therebetween; said valve being further provided with a central bore tube formed through said value, said bore tube having a first fore end and a second aft end; a central bore tube bushing being disposed in and lining the bore tube; a sliding metal spool being disposed in the bore tube for axial movement therein, said spool being formed with a plurality of annular grooves thereon; a first and a second bobbin positioned embracing the fore coil and the aft coil respectively; a first retaining screw disposed through the first bobbin, being received in the first fore end of the bore tube; a second restraining screw being disposed through the second bobbin, being received in the second aft end of the bore tube, whereby first and second restraining screws restrain the spool in the bore; a first upwardly extending bore being formed in the valve in fluid communication with the bore tube, a second upwardly extending central bore being formed in the valve in fluid communication with the bore tube, a third upwardly extending aft bore being formed in the valve in fluid communication with the bore tube, wherein magnetic activation of the fore coil magnetically attracts the spool, thereby blocking liquid flow between the central bore tube and the third bore, and further wherein magnetic activation of the rear coil magnetically attracts the spool, thereby blocking liquid flow between central bore tube and first fore bore; a first conduit means positioned between the hydraulic outlet port and the second central bore for fluid communication therebetween, whereby fluid is supplied to the ballast control valve; the ballast tank actuator means being comprised of a forward chamber, an aft chamber and an actuator diaphragm positioned therebetween, a shaft having a forward end and an aft end being centrally disposed through the actuator and carried by the diaphragm with its longitudinal axis being positioned perpendicularly to and carried by the diaphragm for movement therewith between a first closed position and a second open position; an aperture plug carried on the aft end of the shaft wherein, when in the first closed position, the aperture plug is seated in the aperture blocking the flow of liquid through the aperture of the ballast tank and further wherein, in its second open position, the aperture plug is unseated from the aperture permitting the flow of liquid between the ballast tank and the ambient environment in the hull; a second conduit means positioned between the first bore of the ballast tank control valve and the aft chamber of the ballast tank actuator means for fluid communication therebetween, whereby liquid flowing from the ballast tank control valve to the aft chamber fills said chamber expanding the diaphragm carrying the shaft into its second open position; a third conduit means positioned between the third bore and the forward chamber of the ballast tank actuator for fluid communication therebetween, whereby liquid flowing from the ballast tank control valve to the forward chamber, fills said chamber, expanding the diaphragm, carrying the shaft into its first closed position.

6. The model of claim 5, wherein the shaft of the ballast tank actuator means carries a microswitch actuator on its forward end; and a microswitch being electrically connected to the fore coil and the aft coil, said microswitch being positioned contacting the microswitch actuator when the shaft is in its second open position, wherein when said fore coil is energized, contact of the microswitch by the microswitch actuator energizes the aft coil and de-energizes the fore coil, and vice versa.

* * * * *